United States Patent [19]

Chow

[11] 4,007,041

[45] Feb. 8, 1977

[54] ELECTROPHOTOGRAPHIC PRINTING METHOD

[75] Inventor: Che Chung Chow, Penfield, N.Y.

[73] Assignee: Xerox Corporation, Stamford, Conn.

[22] Filed: Mar. 10, 1975

[21] Appl. No.: 556,841

[52] U.S. Cl. ..... 96/1 LY; 96/1.4; 427/16; 118/203

[51] Int. Cl.[2] ..... G03G 13/14

[58] Field of Search ..... 96/1.4, 1 LY; 427/14, 427/16, 154–156; 106/2; 118/60, 70, 203

[56] References Cited

UNITED STATES PATENTS 3,268,351 8/1966 Van Dorn ..... 118/60

*Primary Examiner*—John D. Welsh

*Attorney, Agent, or Firm*—James J. Ralabate; James P. O'Sullivan; Donald M. MacKay

[57] ABSTRACT

An improved offset printing method is provided in which the blanket roller is coated with an ink releasable material to provide substantially complete transfer of an inked image from the master to the receiver sheet so as to obviate the requirement of cleaning the blanket after each print is made from a new image. The image is preferably formed by electrophotograhic means.

5 Claims, 1 Drawing Figure

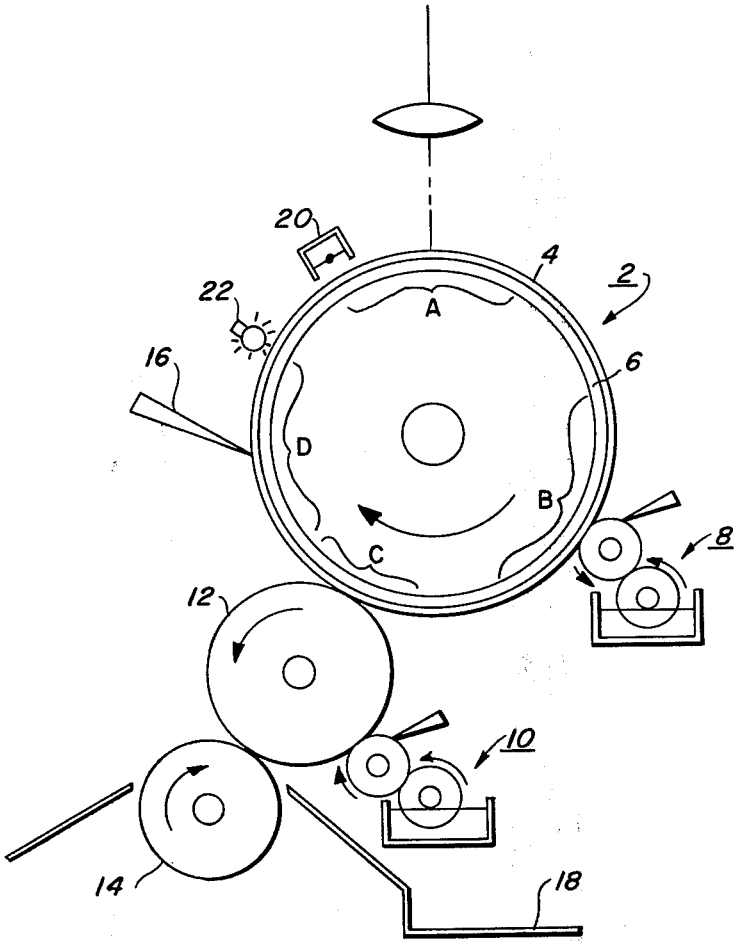
20
22
16
4
2
A
6
D
B
C
8
12
10
14
18

ELECTROPHOTOGRAPHIC PRINTING METHOD

BACKGROUND OF THE INVENTION

In offset printing an imaged master is inked and the image transferred to a receiver sheet by means of an intermediate resilient blanket roller. It is necessary that the blanket roller be cleaned after each new master because a substantial amount of ink remains on the blanket roller after the image is transferred to a receiver sheet. If this ink were not removed, it would degrade the subsequent image to be transferred. The cleaning is usually accomplished by washing the roller with a solvent or multiple prints are made without the addition of new ink until the residual image is reduced to an insignificant level. Because of this cleaning step, the offset process is less suitable for runs of short duration in which the image is often changed but rather the offset printing method lends itself only to high volume duplication from a single master.

BRIEF DESCRIPTION OF THE INVENTION

It has now been discovered that offset printing can be employed for gravure, screen printing, letterpress, lithography and other printing methods for short runs in which master images are frequently changed. More particularly, it has been discovered that if an ink releasable material is applied to the blanket roller prior to inking or transfer of an inked image, substantially all of the ink is transferred to the receiver print so as to obviate the requirement of cleaning the blanket roller after every print. Thus, in accordance with this invention, the offset printing process can be employed for short runs so as to permit the changing of masters even after every print without the necessity for cleaning the blanket roller after every formation of a new image. Other benefits will be apparent from the following detailed description.

BRIEF DESCRIPTION OF THE DRAWING

The drawing is a schematic illustration of a printing apparatus adapted for employing the invention.

DETAILED DESCRIPTION OF THE INVENTION

Reference is made to the drawing in which various system components are illustrated. The photosensitive drum 2 comprises a photoconductive layer 4 including a conductive support substrate and a resilient rubbery substrate 6. Station A is an imaging station, station B an inking station, station C a transfer station and station D a cleaning station. No. 22 is a photoreceptor discharge light, No. 20 a corotron and No. 16 a cleaning wiper blade. Inking station 8 is illustrated by a wiper blade and two inking rollers, one of which is suspended in an ink sump. Station 10 is an ink releasable fluid station depicting a doctor blade and two rollers, one of which is suspended in an ink releasable fluid sump. A paper sheet is fed between blanket roller 12 and a supporting roller 14, which is imaged and received in bin 18.

The photosensitive drum 2 is charged by corotron 20 and imagewise exposed to activating electromagnetic radiation by one of the conventional electrophotographic methods. The resultant electrostatic latent image is developed with an ink in station B. Transfer of the inked image to blanket roller 12 is effected at station C, the remaining ink on the photoconductive drum removed at station D by doctor blade 16 and the photoconductive drum discharged by discharge light 22.

Prior to contact of the inked image with blanket roller 12, and ink releasable fluid is applied at station 10 to effect a complete transfer of ink to the paper sheet fed between blanket roller 12 and paper supporting roller 14. The imprinted paper is discharged into bin 18.

The aforedescribed method comprises a preferred means for employing the process of the invention but many variations are possible. For example, the image can be formed on the master by any conventional means as will be hereinafter described.

Suitable materials, method of imaging and other aspects of the invention will now be described in detail.

Materials which can be employed to coat the blanket roller are fluids which have a cohesive force less than that of the ink. Cohesive force is related to tack and viscosity. The tack and viscosity will depend upon the materials employed but generally the releasable fluid should have a tack and viscosity less than 90 percent of the ink and preferably less than 70 percent of the ink under the operating conditions. For example, in conventional lithographic printing, ink viscosities of between about 10,000 and 50,000 centipoise are employed. Conventional inks generally have a tack between about 10 and 14 but can be as high as 20. (See Reed, Amer. Ink Maker, 1938, 16 No. 2, 37). Other methods are employed, however, such as disclosed in U.S. Pat. No. 3,084,043 herein incorporated by reference wherein viscosities of between 300 and 1000 centipoise are employed.

Typical ink releasable fluids are the silicone oils, mineral oils, vegetable oils and the like. Suitable silicone oils are those having only methyl containing groups in the polymer chain such as poly(dimethylsiloxane), gums having both methyl and phenyl containing groups in the polymer chain as well as gums having both methyl and vinyl groups, methyl and fluorine groups or methyl, phenyl and vinyl groups in the polymer chain. Other materials will occur to those skilled in the art, it only being necessary that the ink releasable material adhere to the blanket roller and not combine with the ink employed. The conventional blanket rollers can be employed such as made of hard rubber or polyurethane and the like. Conventional inks can be employed such as those having a viscosity between about 300 and about 50,000 centipoise, the viscosity depending on the printing process.

Conventional master materials, imaging methods and printing equipment can be employed. Typical masters for the process disclosed in U.S. Pat. No. 3,084,043 have a paper or metal substrate, such as aluminum, overcoated with a photo or light sensitive layer such as selenium, polyvinyl carbazole, trinitrofluorenone or zinc oxide. Other masters may be employed having an image bearing surface to include metal plates or drums to which images have been affixed. For example, an inked image could be developed on a selenium or other photosensitive drum.

In conventional lithography a diazo sensitized lithographic plate can be exposed in imagewise configuration so as to form an image in the light struck areas. The photosensitive coating not exposed to light is then removed by use of a developer in which the coating is soluble. Development is followed by treating the plate in order to make the image areas ink receptive. The plate can then be gummed up with a solution of gum arabic and inked. Alternatively, direct image plates can be employed by typing, by drawing or by taking an impression from the relief image carriers/type and photoengravings. The carrier material is predominantly paper or paper board. Further, electrostatic plates can be employed such as formed by xerography. Plates formed by this method consist of a printing image of fine resin powder which is electrostatically applied to the image carrier, normally a paper plate, and fused to it either by heat or by a solvent fusion method. A second electrostatic process is known as electrofax. By this method, the operations of photography and of plate making are combined. The image carrier area is coated with a light sensitive material which can be directly converted into an image carrier by photographing the copy in a specifically designed electrostatic camera. In addition, deep etch plates can be employed wherein the printing image is recessed in the plate metal to between about 2 and 3 ten thousandths of an inch. The printing areas are made ink receptive by removing a light hardened photomechanical stencil and by applying a non-blinding lacquer (meaning a lacquer which does not lose its ink receptivity in the course of running) to the image or printing areas of the plate.

Conventional methods of imaging can be employed such as xerography, electrography, electrophoretic imaging, migration imaging and manifold imaging. The image can also be formed by means of an ink jet printing apparatus. Other methods will occur to one skilled in the art and the invention is not meant to be limiting in the choice of materials, apparatus or imaging methods which can be employed.

The following examples will serve to illustrate the invention and preferred embodiments thereof. All parts and percentages in said examples and elsewhere in the specification and claims are by weight unless otherwise specified.

EXAMPLES

Employing an apparatus illustrated in the drawing having a photoconductive drum of selenium (50 microns) on brass (3 mil) with a substrate of ¼ inch rubber, a xerographic image was formed on the drum and developed with an ink having a viscosity of 500 centipoise at 25° C comprising 31.1 parts Microlith carbon black (Ciba-Geigy Corporation), 17.4 parts Ganex V216 surfactant or dispersing agent (GAF Corporation) and 51.5 parts Drakeol 8 (Pennsylvania Refining Company). The ink releasable fluid employed was a multiviscosity motor oil (10–30 SAE) with a viscosity at ambient temperature of 180 centipoise. The apparatus is adapted so as to apply the ink releasable fluid on every third revolution of the blanket roller. Excellent prints were obtained with substantially complete transfer of the inked image from the blanket roller to the receiver sheet.

The procedure is repeated substituting a polydimethylsiloxane oil having a viscosity of 10 centipoise (Dow Corning DC200) for the motor oil and similar results are obtained.

Having described the present invention with reference to these specific embodiments, it is to be understood that numerous variations can be made without departing from the spirit of the invention; and it is intended to encompass such reasonable variations or equivalents within its scope.

What is claimed is:

1. An offset printing method is which an image is electrophotographically formed on a drum, developed with an ink and transferred to a receiver sheet by means of an intermediate blanket roller, comprising coating the blanket roller with an ink releasable material such that substantially all the inked image is transferred from the master to the receiver sheet so as to obviate the requirement of cleaning the blanket roller after each print is made from a new image.

2. The process of claim 1 wherein the ink releasable material applied to the blanket roller is mineral oil.

3. The process of claim 1 wherein the ink releasable material applied to the blanket roller is a silicone oil.

4. The process of claim 1 wherein the releasable fluid has a tack and viscosity less than 90 percent of the ink under operating conditions.

5. The process of claim 1 wherein the releasable fluid has a tack and viscosity less than 70 percent of the ink under operating conditions.

* * * * *